United States Patent [19]

Barnsbee et al.

[11] 4,431,139

[45] Feb. 14, 1984

[54] CONTAINER FOR LIGHT-SENSITIVE MATERIAL

[75] Inventors: Clive D. Barnsbee, Webster; Marvin G. Decker, Rochester, both of N.Y.

[73] Assignee: Eastman Kodak Company, Rochester, N.Y.

[21] Appl. No.: 401,755

[22] Filed: Jul. 26, 1982

[51] Int. Cl.[3] ..... B65H 19/02

[52] U.S. Cl. ..... 242/55.53; 206/395; 206/409; 242/71.1; 242/71.7

[58] Field of Search ..... 242/55.53, 71.7, 71.1; 206/389, 395–397, 474, 475, 409; 229/37 R, 37 E, 38, 39 R

[56] References Cited

U.S. PATENT DOCUMENTS

| | | | |
|---|---|---|---|
| 2,743,009 | 4/1956 | Williamson et al. | 206/396 |
| 3,246,742 | 4/1966 | Coe | 206/396 |
| 3,481,457 | 12/1969 | Oberton et al. | 206/395 |
| 3,541,052 | 10/1970 | Kirk | 206/395 X |
| 3,613,973 | 10/1971 | Jaeschke | 206/395 X |
| 4,122,945 | 10/1978 | Borzak | 206/395 |
| 4,235,346 | 11/1980 | Liggett | 220/7 |
| 4,239,164 | 12/1980 | Barnsbee et al. | 242/55.53 |

OTHER PUBLICATIONS

*Research Disclosure*, vol. 150, Oct. 1976, pp. 26–27.

*Primary Examiner*—John Petrakes
*Attorney, Agent, or Firm*—Milton S. Sales

[57] ABSTRACT

A container for light-sensitive material is folded from a blank of thin opaque material. The blank has four rectangular panels hingedly connected so as to be foldable to form a generally rectangular tube with four sides and two open ends. A cap associated with each end of the tube closes the container in a light-tight manner. Interlocking structure is associated with the hinge connections for forming a tortuous light path to inhibit any light leakage through the material at the hinge connection from reaching the contents of the container. Besides the light-locking effect of the interlocking structure, it enhances cartridge strength in that all edges, when folded up, are double thickness of material. The end caps of the container may be blanked with the side panels with a hinge connection between each end cap and one of the side panels. To prevent light leaks, ridges are formed on the side panel and the end cap to form a tortuous path for any light which leaks through the blushed area.

4 Claims, 8 Drawing Figures

CONTAINER FOR LIGHT-SENSITIVE MATERIAL

BACKGROUND OF THE INVENTION

1. Field of the Invention

The present invention relates to dispensing containers for rolls of light-sensitive material.

2. Description of the Prior Art

Containers for dispensing unexposed photographic film or paper from a roll are well known in the art and generally are fabricated of heavy paper, paper board, fiberboard or corrugated paperboard, such as shown in U.S. Pat. No. 3,481,457, which issued Dec. 2, 1969 to D. D. Overton III et al. Some such containers are more economically made of thin, opaque plastic which may be thermoformed into shaped blanks of various desired configurations. After shaping, the blank is folded into a tubular configuration, such as shown in our commonly-assigned U.S. Pat. No. 4,239,164, which issued Dec. 16, 1980.

While thin plastic containers have many manufacturing economies and user advantages, the opaque material of which they are formed has an undesirable characteristic of thinning out when a corner is folded with a small curvature radius. This thinning out, commonly referred to as "blushing," may result in loss of opaqueness and light integrity at the corners. To prevent blushing, the container shown in the above U.S. patent utilizes curved corners of large radii and separate end caps supplied after the main container body has been formed. While this offers a good light-tight container for many uses, there are certain advantages to having a container with sharper edges and integral end caps. To this end, the present invention provides light protection for the contents of such containers even though blushing can occur. Besides the light protection feature, the invention also provides double material thicknesses at the corners for structural strength.

SUMMARY OF THE INVENTION

In accordance with the present invention, an improved container is provided for light-sensitive material. The container is folded from a blank of thin, opaque material. The blank has four rectangular panels hingedly connected so as to be foldable to form a generally rectangular tube with four sides and two open ends. A cap associated with each end of the tube closes the container in a light-tight manner.

Because the blank material may blush when folded, interlocking structure is associated with the hinge connections for forming a tortuous light path to inhibit any light which may leak through the material at the hinge connection from reaching the contents of the container. The interlocking structure includes a ridge on the inner surface of one panel adjacent each hinge, the ridge surface being spaced from the associated hinge by a predetermined distance. A second ridge on the inner surface of the other panel adjacent each hinge is close to the hinge so that when the hinge is folded, whereby the panels are normal to each other, the ridges form a tortuous light path from the hinge to the interior of the container. Besides the light-locking effect of the ridges, they provide a very strong cartridge in that all edges, when folded up, are double thickness of material.

The ridges extend inwardly of the panels and occupy volume within the container. This does not present a problem at the edges of the panels because the rolls within the containers do not extend into the corners of the containers. By tapering the ridges off toward the center of the panels, the diameter roll receivable in the container can be maximized.

The end caps of the container may be formed integral with the side panels, with a hinge connection between each end cap and one of the side panels. Such a hinge connection would be subject to the same blushing problem as the hinge connection between the side panels. To prevent light damage to the container contents, ridges are formed on the side panel and the end cap to form a tortuous path for any light which leaks through the blushed area.

Suspension plugs may be formed on the inner surfaces of the end caps, fitting within the inner core of a roll of light-sensitive material to keep the roll centered in the container. When such plugs are formed such as by thermoforming, the outer surfaces of the end caps have recesses therein such as shown in aforementioned U.S. Pat. No. 4,239,164. To some, the recess might be considered to be unattractive. We have provided flaps on the blank for folding over the outside of the end caps, to cover the recesses and provide a flush appearance to the container.

The invention, and its objects and advantages will become more apparent in the detailed description of the preferred embodiments presented below.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENT

Figure 1:
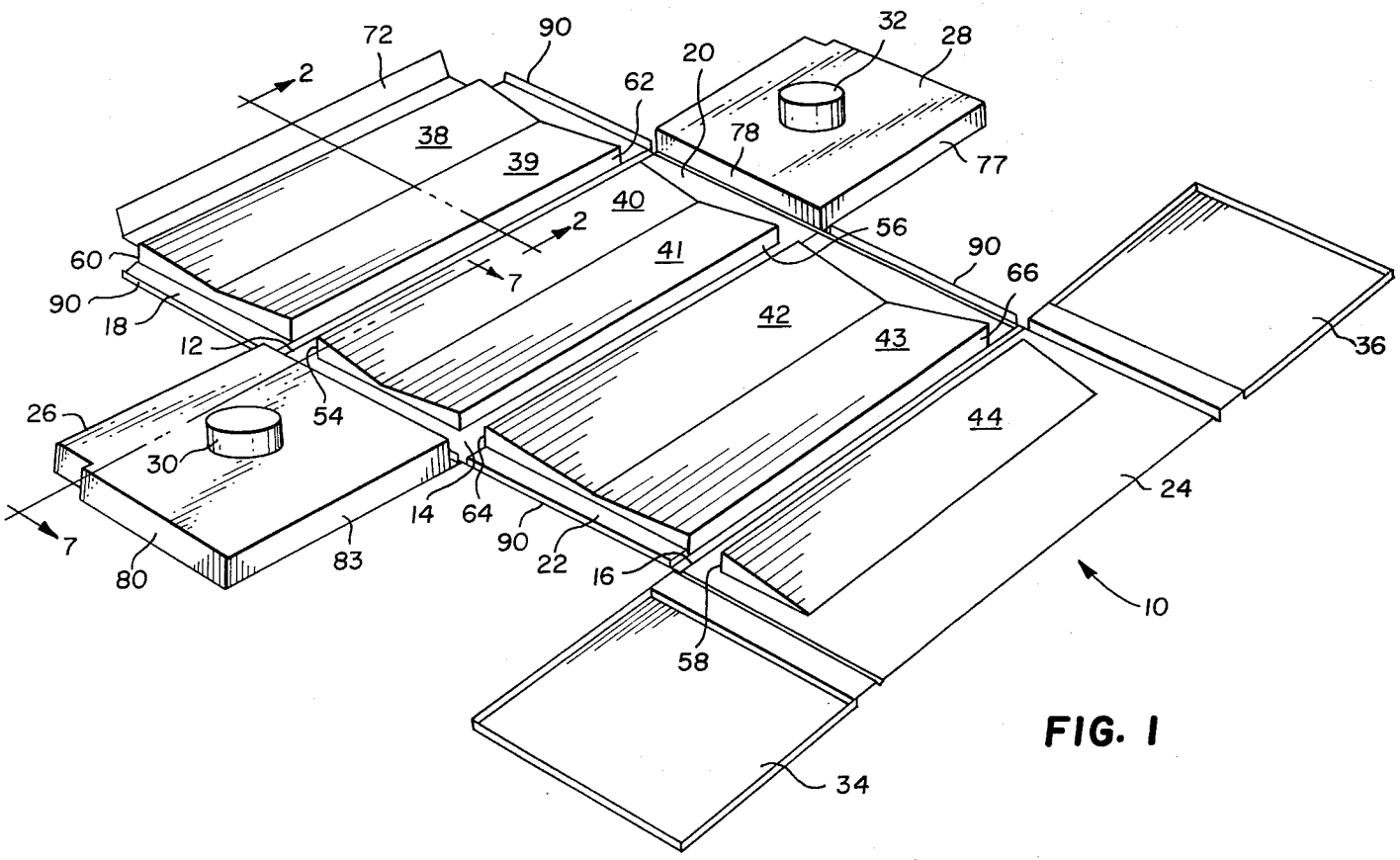
FIG. 1 is a perspective view of a container blank, in accordance with the present invention, in unfolded configuration.

Referring to FIG. 1, a container according to the present invention includes a shell formed from a foldable blank 10. The blank includes hinge lines 12, 14, and 16 which define four rectangular panels 18, 20, 22, and 24 connected together in series along mutually parallel edges of the panels. Blank 10 is foldable upon the hinge lines to form a rectangular tube.

A pair of end caps 26 and 28 are hingedly connected to panel 20. End caps 26 and 28 have formed-in roll suspension plugs 30 and 32. A pair of end cap covers 34 and 36 are hingedly connected to panel 24.

Blank 10 may be made from a variety of suitable opaque material such as fiberboard and corrugated paperboard which possess desirable puncture, compression, and bursting strengths. However, in the preferred embodiment, the blank is made from thermoplastic material such as polystyrene to which a suitable pigment, carbon black for example, has been added for opacity. The blank preferably is formed by well-known thermoforming techniques from a sheet of such material.

In accordance with the invention, means are provided in association with panels 18, 20, 22, and 24 for increasing the strength of the container and for forming a tortuous path to inhibit any light which may leak around the edges of the panels from reaching the interior of the container. In a preferred embodiment, such means includes a plurality of ramp-shaped ridges 38–44 formed in the panels.

Ridges 40, 41, and 42 have, respectively, surfaces 54, 56, and 58 which are substantially normal to the panel and spaced along the inner surface of the panels by a predetermined distance from the associated hinge connection. In contrast, surfaces 60, 62, 64, and 66 on ridges 38, 39, 42, and 43, respectively, are closely adjacent to their associated hinge connection. Surfaces 60, 62, 64, and 66 extend normal to the panel by a height substantially equal to the distance that surfaces 54, 56, and 58 are spaced from the hinge connections.

Figure 2:
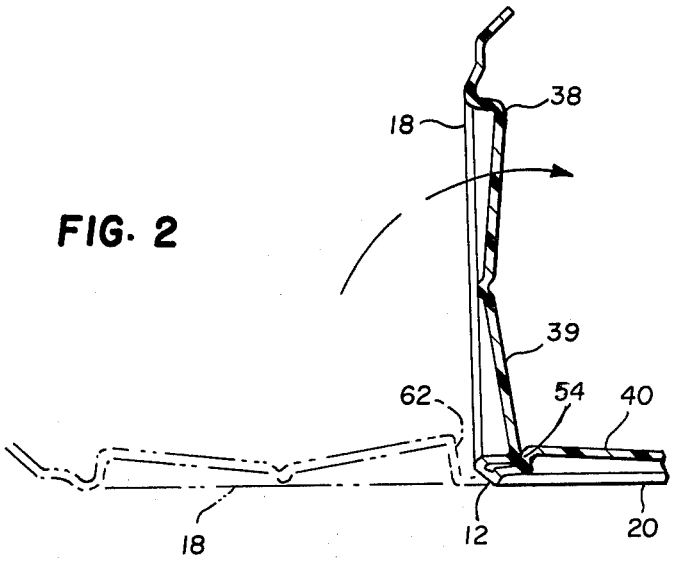
FIG. 2 is a sectional view taken through line 2—2 of FIG. 1 showing two container panels in folded and unfolded configurations.

FIG. 2 shows the manner of cooperation between the panel and ridge surfaces on either side of a hinge connection both to stiffen the corners and to inhibit any light which may leak through the thinned-out, or "blushed," hinge. As panel 18 is folded at hinge 12, surface 62 of ridge 39 folds into the space between surface 54 and the hinge. Should the material "blush" at the hinge connection, any light which leaked through the material in that region must travel along the space between panel 20 and surface 62, turn 90°, and travel between ridge 39 and surface 54 before reaching the interior of the container. This tortuous path for the light assures ample protection and a lightlock for the contents of the container. Light protection is enhanced when surface 62 of the ridge is brought into intimate contact with the adjacent surface of panel 20. Also, the double thickness of material at the corners provides added stiffness to the package.

Figure 3:
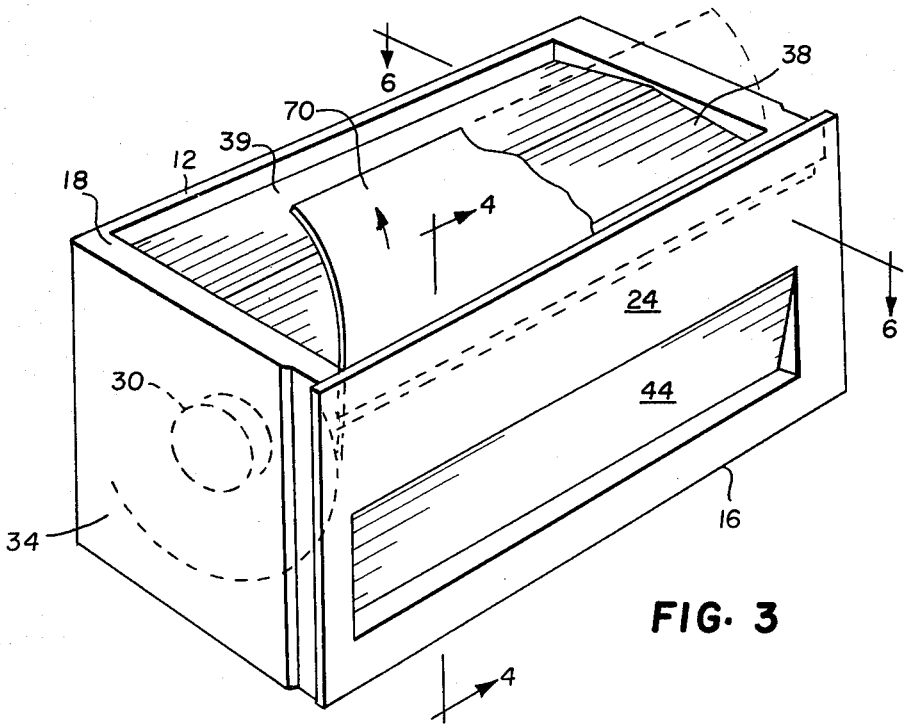
FIG. 3 is a perspective view of the folded and loaded container according to the present invention.

FIG. 3 shows the completed container, all panels, end caps and end cap covers having been folded. The illustration includes a roll of light-sensitive material as it would be packaged in the container. While FIG. 2, described above, illustrates the structure at hinge line 12, it is to be understood that the same light protection and stiffening effects are provided at three corners of the rectangular tube formed by panels 18, 20, 22, and 24; i.e., at hinge lines 12, 14, and 16.

Figure 4:
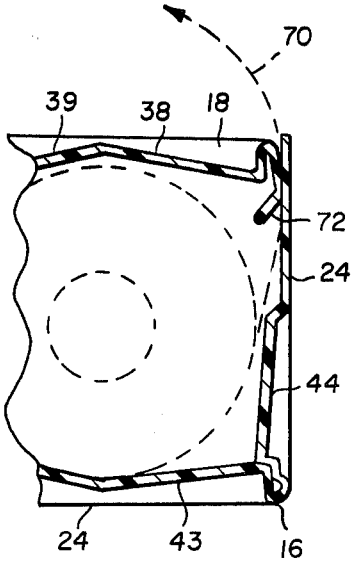
FIG. 4 is a sectional view taken along line 4—4 of FIG. 3.

The fourth corner (shown sectioned in FIG. 4) forms an exit slot for light-sensitive material 70. A lip 72 is folded over from panel 18 and tucked into the container interior inside of panel 24. Lip 72 is urged toward panel 24 by its resiliency to inhibit light from entering the container. Plush material may be added to one or both sides of the exit slot to enhance the light protection. The exit slot may take various forms; a suitable example is shown in aforementioned U.S. Pat. No. 4,239,164. Of course, it will be understood that the illustrated container is but one embodiment of the present invention, and that containers according to other embodiments may not have exit slots.

Figure 5:
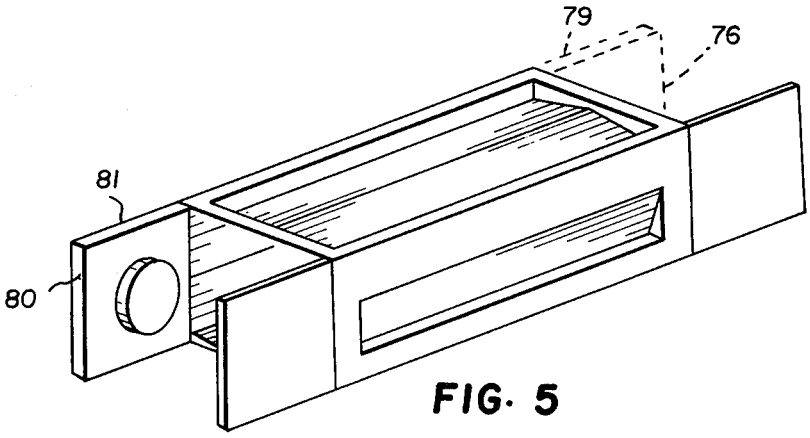
FIG. 5 shows an assembly stage during the operation of forming the container blank into an open box.

After the panels have been folded to form a tube with four sides and two open ends as shown in FIG. 5, and a roll of strip material loaded into the tube, end caps 26 and 28 are folded inwardly to close the container. The hinge connection between the end caps and panel 20 are subject to blushing (and consequently to light-leaks) just as are hinge connections 12, 14, and 16. There is also the risk of light leak around the other three edges of each end cap 26 and 28. Structure associated with the end caps for inhibiting such light leaks will now be described.

Figure 6:
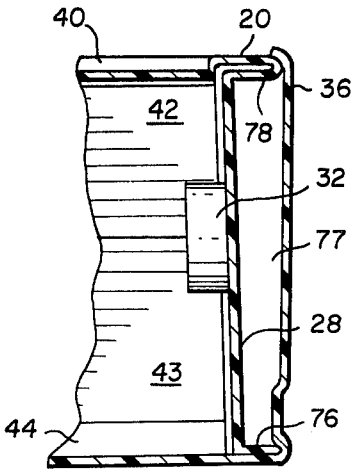
FIG. 6 is a sectional view taken along line 6—6 of FIG. 3.
Figure 7:
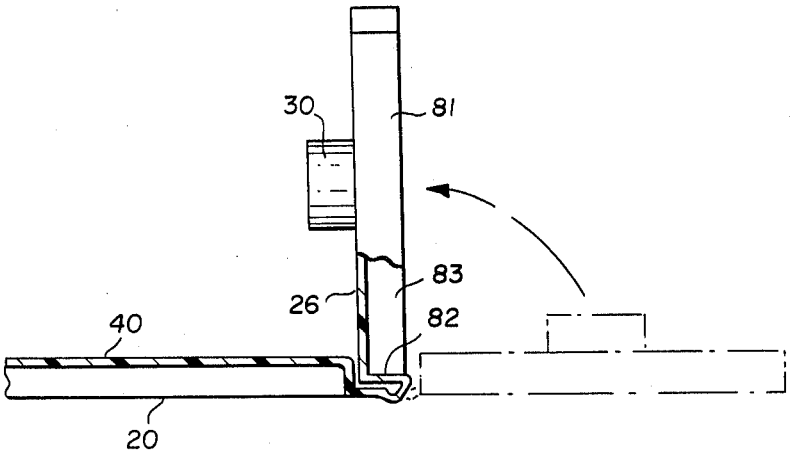
FIG. 7 is a sectional view taken along line 7—7 of FIG. 1 showing an end cap in folded and unfolded configuration.

The end caps are formed with outwardly projecting flanges (76–79 on end cap 28 and 80–83 on end cap 26, as shown in FIGS. 1, 5 and 6). When the end caps are folded in as shown in FIGS. 6 and 7, the flanges touch or lie closely adjacent to respective surfaces of panels 18, 20, 22 and 24. Any light which might travel inwardly between the end cap flanges and the side panels impinges upon the ends of ridges 38–44, and is prevented from reaching the interior of the container.

Figure 8:
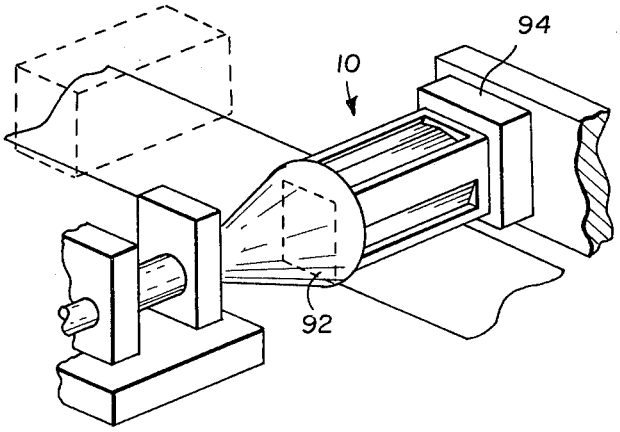
FIG. 8 is a schematic view of a container sealing operation.

Side panels 18 and 22 have small lips 90 formed on each end (FIG. 1). When blank 10 is folded up to form a carton, these lips extend over the associated flange 77, 79, 81, and 82 of end caps 26 and 28. Sealing the lips to the flanges completes the enclosure, and this may be done ultrasonically as shown in FIG. 8 using an ultrasonic horn and anvil 92 and 94, respectively.

Side panel 24 may also have a set of lips similar to lips 90, but for the preferred embodiment, we have provided end cap covers 34 and 36. Before sealing, the covers are folded over the exterior of the end caps to product a flush appearance to the container.

The invention has been described in detail with particular reference to a preferred embodiment thereof, but it will be understood that variations and modifications can be effected within the spirit and scope of the invention.

What is claimed is:

1. A container for light-sensitive material, said container comprising:

first, second, third, and fourth rectangular panels of opaque material hingedly connected together in series along mutually parallel edges of said panels so as to be foldable at said edges to form a generally rectangular tube with four sides and two open ends;

a cap associated with each end of said tube and adapted to close the container in a light-tight manner; and interlocking structure associated with said hingedly connected panel edges, said interlocking structure including (a) a first ridge having a surface on, and normal to, one panel adjacent each hinge connection, said ridge surface being spaced from the associated hinge connection by a predetermined distance, and (b) a second ridge having a surface on the other panel adjacent each hinge connection, said surface of the second ridge being substantially adjacent to its associated hinge connection and extending generally normal to its associated panel a distance substantially equal to said predetermined distance, so that when the hinge is folded such that the panels are generally normal to each other, the ridges increase the strength of the container and form a tortuous light path from the hinge to the interior of said container to inhibit any light which may leak through the hinge connection from reaching the material in the container.

2. A container as claimed in claim 1 further comprising means associated with the free edges of said first and fourth panels for forming a light-tight exit slot for removing light-sensitive material from within said container.

3. A container as claimed in claim 1 wherein said ridges are substantially triangular shaped when viewed from the ends of said tube, tapering away from each associated hinge connection toward the center of the panels, whereby the diameter of a roll of light-sensitive material in said container may be maximized.

4. A container as claimed in claim 1 wherein:

each of said caps is hingedly connected to one of said panels; and said first and second ridges cooperate with said caps to form a tortuous path for any light which might leak around the caps.

* * * * *